US006309260B1

(12) United States Patent
Shannon

(10) Patent No.: US 6,309,260 B1
(45) Date of Patent: Oct. 30, 2001

(54) SOLDER-IN-PLACE CONNECTOR

(75) Inventor: John K. Shannon, Franksville, WI (US)

(73) Assignee: Quick Cable Corp., Franksville, WI (US)

( * ) Notice: Subject to any disclaimer, the term of this patent is extended or adjusted under 35 U.S.C. 154(b) by 0 days.

(21) Appl. No.: 09/502,844

(22) Filed: Feb. 11, 2000

(51) Int. Cl.[7] ..... H01R 4/50
(52) U.S. Cl. ..... 439/772; 174/84 R
(58) Field of Search ..... 439/772, 884; 174/84 R

(56) References Cited

U.S. PATENT DOCUMENTS

| | | | | |
|---|---|---|---|---|
| 1,188,055 | | 6/1916 | Faile . | |
| 1,694,149 | | 12/1928 | Vawter . | |
| 2,838,593 | * | 6/1958 | Scesa et al. | 174/84 R |
| 2,972,657 | | 2/1961 | Stemke | 174/84 |
| 3,243,211 | | 3/1966 | Wetmore | 287/78 |
| 3,316,343 | | 4/1967 | Sherlock | 174/84 |
| 3,326,442 | | 6/1967 | Fattor | 228/56 |
| 3,519,982 | | 7/1970 | White, Jr. | 339/275 |
| 4,664,468 | * | 5/1987 | Woodworth | 439/772 |
| 4,687,280 | * | 8/1987 | Toy et al. | 439/874 |
| 4,889,506 | | 12/1989 | Connolly et al. | 439/874 |
| 5,281,167 | | 1/1994 | Le et al. | 439/578 |

* cited by examiner

*Primary Examiner*—Brian Sircus
*Assistant Examiner*—Brian S. Webb
(74) *Attorney, Agent, or Firm*—Jansson, Shupe & Munger, Ltd.

(57) ABSTRACT

The invention involves a battery connector electrically connecting a multi-strand automotive-type cable to an automotive-type battery terminal where the battery connector is comprised of a connecting portion for engagement with an automotive-type battery terminal and a rigid cable-attachment portion that includes a non-deformable neck that extends from the connecting portion and defines a cavity having a depth, a closed inner end, an open outer end and a cross-sectional area that is substantially equal along the entire depth between the inner end and the outer end as well as substantially equal to the diameter of the cable. Solder is secured within the cavity, and flux is secured within the cavity in contact with the solder. The solder and flux are both of amounts suitable for soldering engagement of the cable to the cable-attachment portion, thereby facilitating soldering of the automotive-type cable to the battery connector.

15 Claims, 3 Drawing Sheets

FIG. 1
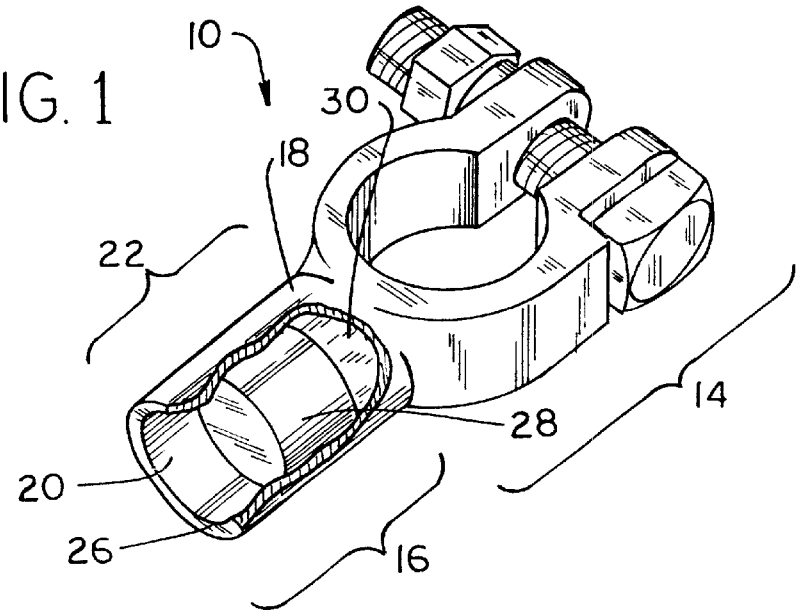
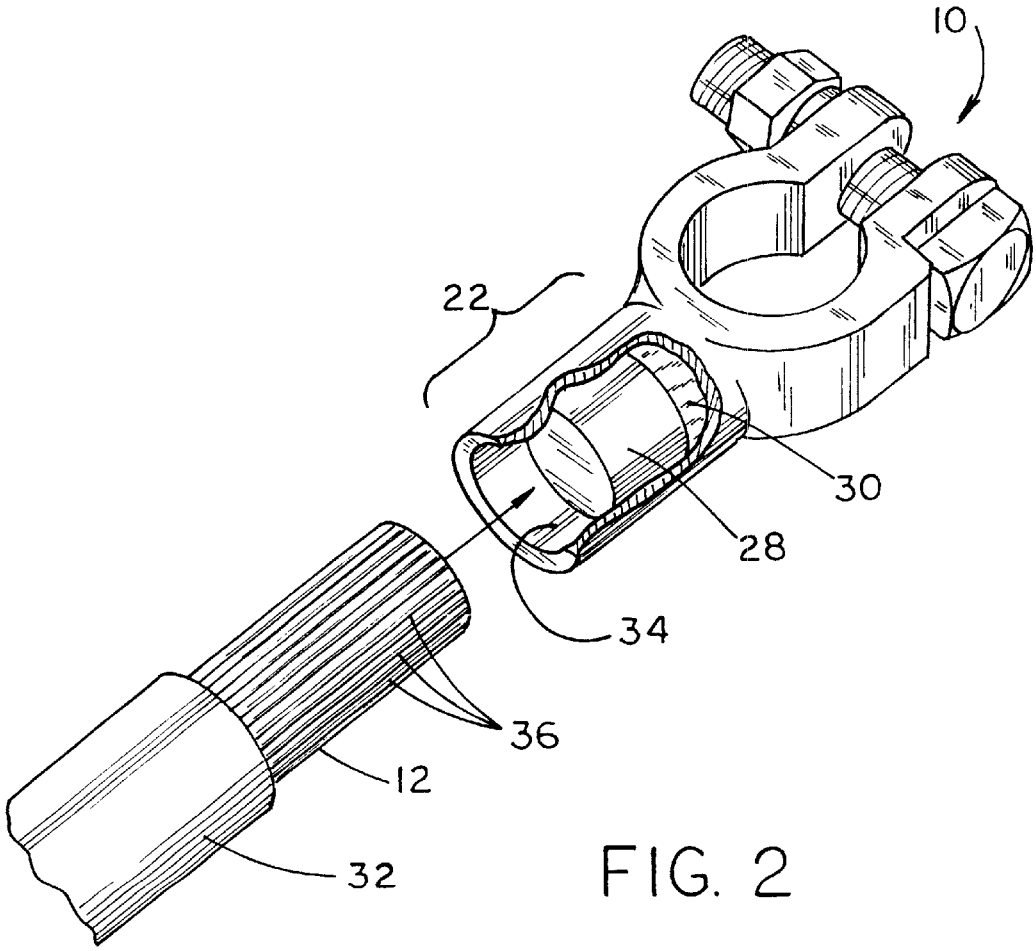
FIG. 2

SOLDER-IN-PLACE CONNECTOR

FIELD OF THE INVENTION

This invention is related generally to electrical connectors for connecting cables with terminals and, more particularly, to connectors for connecting automotive-type cables with battery-terminal connectors—and to methods for attaching electrical cables to connectors.

BACKGROUND OF THE INVENTION

A great variety of connectors are used for connecting cables of various types with terminals of various types. Such connectors each have (1) a connecting portion 14 by which the connector removably engages a terminal (e.g., an automotive battery terminal or the like) and (2) a cable-attachment portion by which the cable is permanently assembled with the connector, at the appropriate time, so that the cable thereafter can easily and removably be electrically connected to a terminal.

Attaching a cable to the cable-attachment portion of such a connector is carried out in a variety of ways—e.g., crimping, soldering, winding, bolting, etc. Various attachment means and methods used have a number of drawbacks and problems, particularly with respect to the specific field of this invention—connectors for automotive-type multi-strand cable.

As used herein, the term "automotive-type" refers to battery connectors for self-propelled vehicles of various kinds, including but not limited to vehicles powered by internal combustion engines or by battery power, or by any combination of the two (including, e.g., automobiles, trucks, planes, fork-lifts and carts, boats, locomotives or the like), and also refers to connectors used in conjunction with stationary batteries such as those associated with stand-by power supplies.

As used herein, the term "battery" refers to a storage device for electrical energy, typically embodied in the common automotive-type lead-acid battery, but which also includes other battery chemistries (e.g., lithium polymer, nickel-cadmium and the like), fuel cells, photovoltaic-battery combination and the like.

Soldering is one method used for attachment of multi-strand automotive-type cable to battery connectors. Such soldering attachment involves a number of common steps, typically including introducing molten solder or solder pellets at the point or area of attachment and bringing the multi-strand cable and connector into simultaneous contact with molten solder. The process is time-consuming and often inconsistent, and can result in varying attachments of widely-varying strength and reliability and in some cases varying electrical consistency. The process also carries with it certain risks involving the molten solder.

During use, automotive-type battery connectors of the prior art can in some cases experience strain on the part of the cable which is immediately adjacent to the connector—i.e., the part adjacent to the portion of the cable which is used for attachment to the battery connector. The strains imposed on the cable by any repetitive bending action can weaken the cable and its attachment to the connector.

Soldered attachment of a multi-strand cable to a connector using what might be referred to as "pre-positioned" solder has published in the past. This is seen in the disclosure of U.S. Pat. No. 1,188,055 (Faile). However, such device would be prone to have significant problems which would render it unacceptable, as hereafter explained.

For one thing, the Faile connector has a cable-attachment cavity in which the diameter of the open end is smaller than the diameter of the inner end, a feature intended to prevent the solder from falling out before attachment of the cable with the connector. A significant shortcoming of the Faile device is that a thorough connection cannot be formed between the cable and the internal surfaces of the cavity—i.e., the end and the sidewalls of the cavity. Such an incomplete connection can lead to electrical and structural deficiencies. The configuration will result in air pockets or voids adjacent to surfaces of the multi-strand cable—surfaces therefore wasted in that they then fail to provide electrical pathways otherwise possible. Furthermore, internal surfaces of the Faile cable-receiving cavity are not protected from accumulation of contaminates and are not protected from corrosion, and such surface problems may then degrade effectiveness of the electrical union at surfaces of attachment. Not only would the electrical connection be wanting, but "cold solder" problems could result and structurally weak connections would result given that only a small portion of the end of the cable would be joined to the solder. Over time, such connection can more readily break, thereby allowing the cable to be pulled from the connector.

In summary, in the prior art a number of very significant disadvantages exist with respect to soldered and other attachment of multi-strand automotive-type cable to automotive-type connectors, and a need exists for substantial advances.

While the specific field of automotive-type battery connectors has its own specific problems and concerns, particularly with respect to permanent attachment of multi-strand cable to such connectors by soldering, it should be noted that various devices involving pre-placed solder exist in the more general field of connectors for connecting electrical wire to terminals. Prior connectors to which single-strand wire is attached by soldering using pre-placed solder, including connectors for use in radio, television and computer applications and the like, are disclosed in various United States patents.

For example, U.S. Pat. No. 3,519,982 (White, Jr.) discloses the use of pre-placed solder in conjunction with small wires in a process which also involves crimping. These devices, which are designed for use with small conductors about 1/0 gauge (0.351 inch diameter) down to about 40 gauge (0.00314 inch diameter), involve the use of solder paste spread along the inner surface of the connector. In conjunction with the crimping of the connector around the cable, heat is applied to the connector thereby melting the solder and reinforcing the attachment. While useful for small conductors, such an attachment is not useful for automotive-type multi-strand electrical cables and connectors.

U.S. Pat. Nos. 3,243,211 (Wetmore) and 3,316,343 (Sherlock) disclose connectors that are made of fusible materials that melt around the cable. These connectors may also employ pre-positioned solder to aid in attaching the cable to the connector. A major shortcoming of these devices is that the fusible connectors are not large enough or strong enough to contain multi-strand automotive-type electrical cables.

U.S. Pat. No. 5,281,167 (Le et al.) discloses a connecting device which utilizes solder that is held in position by a flange. Such a flange restricts the opening of the connector thereby limiting the diameter size of the cable to be attached.

A connector facilitating easy, permanent attachment thereto of automotive-type multi-strand electrical cable would be an important improvement in the art.

OBJECTS OF THE INVENTION

It is an object of the invention to provide an electrical connector and method of permanently attaching a connector to a multi-strand automotive-type cable that overcomes some of the shortcomings of the prior art.

It is another object of the invention to provide an electrical connector and method of permanently attaching a connector to a multi-strand automotive-type cable that allows the flux to be protected from contact with any impurities.

Still another object of the invention is to provide an electrical connector and method of permanently attaching a connector to a multi-strand automotive-type cable where the solder body is formed in situ in the cavity.

Still another object of the invention is to provide an electrical connector and method of permanently attaching a connector to a multi-strand automotive-type cable that eliminates air pockets between the solder and the cylindrical wall thereby reducing the possibility of contamination and corrosion and increasing electrical contact and conductivity.

Yet another object of the invention is to provide an electrical connector and method of permanently attaching a connector to a multi-strand automotive-type cable where the flux is hermetically sealed with the connecting cavity.

It is another object of the invention to provide an electrical connector and method of permanently attaching a connector to a multi-strand cable that results in a more secure attachment of the electrical cable to the connector. How these and other objects are accomplished will become apparent from the following descriptions and from the drawings.

SUMMARY OF THE INVENTION

The invention involves a battery connector for electrically connecting a multi-strand automotive-type cable to an automotive-type battery terminal where the battery connector is comprised of a connecting portion for engagement with a battery terminal and a rigid cable-attachment portion that includes a non-deformable neck that extends from the connecting portion and defines a cavity having a depth, a closed inner end, an open outer end and a cross-sectional area that is substantially equal along the entire depth between the inner end and the outer end as well as substantially equal to the diameter of the cable. Solder is secured within the cavity, and flux is secured within the cavity in contact with the solder. The solder and flux are both of amounts suitable for soldering engagement of the cable to the cable-attachment portion, thereby facilitating soldering of the automotive-type cable to the battery connector.

The pre-positioning of the solder and flux within the cavity removes the need to add molten solder to the connector once the cable is inserted thereby reducing the possibility that one may burn themselves while connecting the multi-strand cable to the connector. By pre-positioning an appropriate amount of solder that bathes the inner end and all sides of the connector cavity, a solid connection is achieved that eliminates the need to crimp the neck of the connector. This allows for the use of a rigid neck that offers greater protection to the cable strands secured within the cavity.

In one embodiment of the invention, the multi-strand cable is surrounded by insulation and includes a length free of insulation that is equal to or greater than the depth of the cavity.

In still another embodiment of the invention, the amount of the solder used is such that at least about one-half of the depth of the cavity is filled with solder thereby allowing for a stronger connection with the cable as the melted solder is displaced along the sides of the cavity and between the portions of the cable strands outside of and adjacent to the cavity.

In another embodiment of the invention, the cavity has a cylindrical lateral wall and the solder conforms to and is joined with the lateral wall. Such an embodiment eliminates air pockets between the solder and the cylindrical wall thereby reducing the possibility of the sidewalls becoming contaminated with impurities, thus preventing corrosion and subsequent degradation of the connection. In a more specific version of such embodiment, the solder is a solder body formed in situ in the cavity. Such an embodiment eliminates any air pockets or open space that would weaken the strength of the connection.

In still another embodiment of the invention, the flux is a mass in contact with the inner end of the cavity. In a specific version of the preferred embodiment, the flux is sealed within the cavity. In yet a more specific embodiment, the flux is sealed within the cavity by the solder.

Another aspect of the invention involves a method for permanently attaching a multi-strand electric cable to a battery connector comprising: (1) providing a battery connector having (a) a connecting portion that is suitable for engagement with a battery terminal, (b) a rigid cable-attachment portion that has a non-deformable neck that extends from the connecting portion where the neck defines a cavity with a closed inner end, an open outer end and a cross-sectional area that is substantially equal along substantially the entire depth between the inner end and the outer end as well as substantially equal to the diameter of the cable, (c) solder secured within the cavity and (d) flux secured within the cavity in contact with the solder; (2) inserting the multi-strand electric cable into the cavity; (3) applying heat to the neck to melt the flux and the solder; (4) further inserting the cable into the cavity to facilitate movement of the solder and flux along the strands and the surface of the cavity; and (5) removing the heat to allow solidification of the solder.

In another embodiment of the method, the multi-strand cable has an insulation-free section of sufficient length such that the further inserting step allows the end of the cable to contact the inner end of the cavity.

In yet another embodiment of the method, the further inserting of the cable displaces the melted flux and solder thereby causing the flux and solder to wick-up beyond the cavity and amongst the cable strands.

In still another embodiment of the method, heat is applied to the neck to melt the flux and the solder prior to inserting the cable into the cavity.

The invention also involves a combination connector and multi-strand cable made by the process comprising the steps of (1) providing a battery connector having (a) a connecting portion for engagement with the battery terminal, (b) a rigid cable-attachment portion with a non-deformable neck extending from the connecting portion, the neck defining a cavity with a closed inner end, an open outer end and a cross-sectional area that is substantially equal along substantially the entire depth between the inner end and the outer end as well as substantially equal to the diameter of the cable, (c) solder secured within the cavity and (d) flux secured within the cavity in contact with the solder; (2) inserting the multi-strand electric cable into the cavity; (3) applying heat to the neck to melt the flux and the solder; (4) further inserting the cable into the cavity to facilitate movement of the solder and flux along the strands and the surface of the cavity and beyond the cavity and between the strands; and (5) removing the heat to allow solidification of the solder.

Another embodiment of the invention involves a battery connector for electrically connecting a multi-strand cable having a diameter to a battery terminal, the battery connector comprising a connecting portion for engagement with a battery terminal and, a rigid cable-attachment portion including a non-deformable neck extending from the connecting portion and defining a cavity having a depth, a closed inner end, an open outer end and a cross-sectional area that is substantially equal along substantially the entire depth between the inner end and the outer end as well as substantially equal to the diameter of the cable, solder secured within the cavity, and flux secured within the cavity in contact with the solder, the solder and flux being of amounts suitable for soldering engagement of the cable to the cable-attachment portion, thereby facilitating soldering of the multi-strand cable to the battery connector.

BRIEF DESCRIPTION OF THE DRAWINGS

The drawings illustrate preferred embodiments which include the above-noted characteristics and features of the invention. The invention will be readily understood from the descriptions and drawings. In the drawings:

FIG. 1 is a perspective view of a battery connector with a cut-away portion showing the solder body and flux positioned in the neck of the connector.

FIG. 2 is a perspective view of a battery connector and a multi-strand cable such as the type commonly used with a battery connector where the battery connector has a cut-away portion showing the solder body and flux positioned in the neck of the connector.

DETAILED DESCRIPTION OF PREFERRED EMBODIMENTS

Figure 3A:
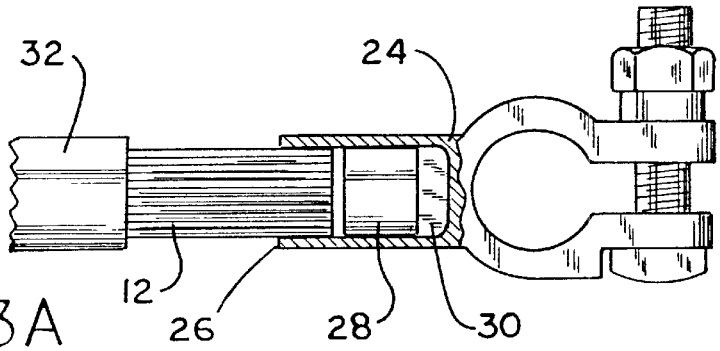
FIG. 3A is a top view of the battery connector and multi-strand cable showing a sectional view of the neck of the connector with flux and solder bodies positioned at the inner end of the neck cavity.
Figure 3B:
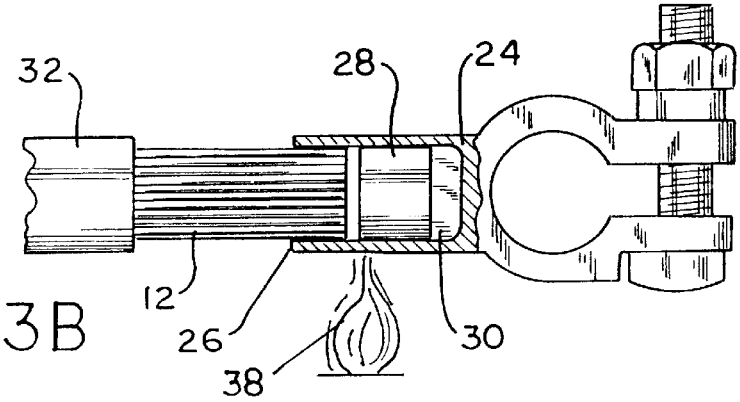
FIG. 3B is a top view of the battery connector and multi-strand cable showing heat being applied to the connector and a sectional view of the neck of the connector with flux and solder bodies positioned at the inner end of the neck cavity.
Figure 3C:
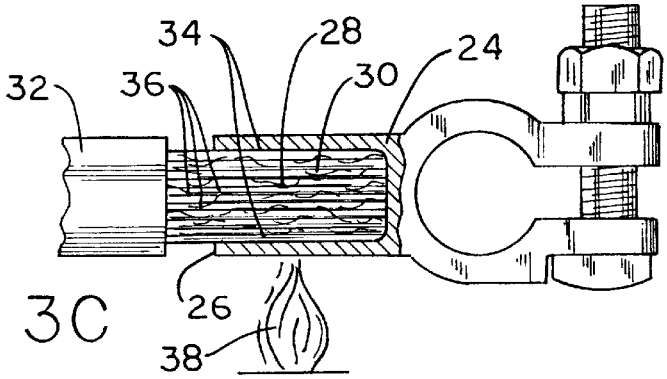
FIG. 3C is a top view of the battery connector and multi-strand cable showing heat being applied to the connector, the cable fully inserted into the neck cavity, and a sectional view of the neck with molten solder and flux along the cavity walls and between the strands of the cable.
Figure 3D:
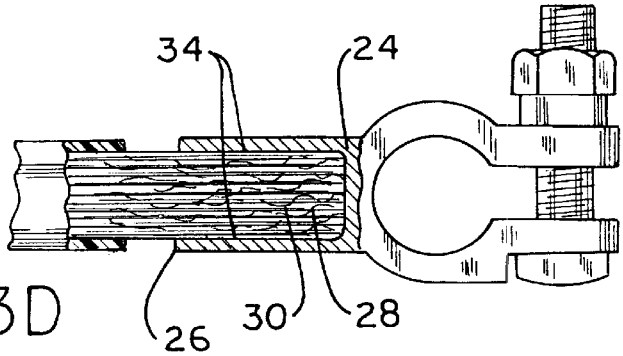
FIG. 3D is a top view of the battery connector and multi-strand cable showing the cable fully inserted into the neck cavity and a sectional view of the neck with molten solder and flux along the cavity walls and extending between the strands of the cable under the insulation.

FIG. 1 shows the invention which involves a battery connector 10 for electrically connecting a multi-strand automotive-type cable 12 to an automotive-type battery terminal (not shown) where the battery connector 10 is comprised of a connecting portion 14 for engagement with an automotive-type battery terminal and a rigid cable-attachment portion 16 that includes a non-deformable neck 18 that extends from the connecting portion 16 and defines a cavity 20 having a depth 22, a closed inner end 24, an open outer end 26 and a cross-sectional area that is substantially equal along the entire depth 22 between the inner end 24 and the outer end 26 as well as substantially equal to the diameter of the cable 12, thereby facilitating a "snug" fit with the cable 12 (i.e., without substantial play between the cable 12 and cable-attachment portion 16). Solder 28 is secured within the cavity 20, and flux 30 is secured within the cavity 20 in contact with the solder 28. The solder 28 and flux 30 are both of amounts suitable for soldering engagement of the cable 12 to the cable-attachment portion 16, thereby facilitating soldering of the automotive-type cable 12 to the battery connector 10.

In one embodiment of the invention, as shown in FIGS. 2 and 3A–D, the multi-strand automotive-type cable 12 is surrounded by insulation 32 and includes a length free of insulation 32 that is equal to or greater than the depth 22 of the cavity 20, thereby allowing the insulation-free portion of the cable 12 to completely fill the cavity 20. This ensures a more thorough connection between the cable 12 and the connector 10 as the melted solder 28 and flux 30 is displaced by the cable 12 and forced along the sidewalls 34 of the cavity 20. Furthermore, the displacement of the melted solder 28 and flux 30 also causes the solder 28 to "wick-up" between the strands 36 of the cable 12 in the cavity 20 and beyond thereby creating a natural strain relief and strengthening of the cable 12 that prevents the cable 12 from flexing along the portion of its length closest to the cable-attachment portion 16 of the connector 10. This strengthening prevents the cable 12 from being broken as a result of repeated flexing in the vicinity of the connector 10.

Because the diameter of the cable 12 is substantially equal to the cross-sectional area of the cavity 20, little or no free space exists within the cavity 20 once the cable 12 is inserted. This lack of free space causes the molten solder 28 and flux 30 to seep between all of the strands 36 of the cable 12.

In another embodiment of the invention, at least about one-half of the depth 22 of the cavity 20 is filled with solder 28 thereby increasing the strength of the connection. Such filing of the cavity 20 facilitates the aforementioned wicking-up of the melted solder 28 and flux 30.

In another embodiment of the invention, the cavity 20 has a cylindrical lateral wall 34 and the solder 28 conforms to and is joined with the lateral wall 34. Such an embodiment eliminates air pockets between the solder 28 and the cylindrical wall 34 thereby reducing the possibility of the sidewalls 34 becoming contaminated, thus preventing corrosion and subsequent degradation of the connection. In a more specific version of such embodiment, the solder 28 is a solder body formed in situ in the cavity 20. Such an embodiment eliminates any air pockets or open space that would weaken the strength of the connection.

FIGS. 1, 2 and 3A–B shows still another embodiment of the invention where the flux 30 is a mass in contact with the inner end 24 of the cavity 20. In a specific version of the preferred embodiment, the flux 30 is sealed within the cavity 20. In yet a more specific embodiment, the flux 30 is sealed within the cavity 20 by the solder 28 where it is protected from contamination thus ensuring a stronger connection.

In a more preferred embodiment of the invention, the flux 30 is a coating that is sealed within the cavity 20, and more preferredly, the flux 30 is sealed within the cavity 20 by the solder 28.

FIGS. 3A–D depict another aspect of the invention which involves a method for permanently attaching a multi-strand automotive-type electric cable 12 to a battery connector 10 comprising: (1) providing a battery connector 10 having (a) a connecting portion 14 that is suitable for engagement with an automotive-type battery terminal, (b) a rigid cable-attachment portion 16 that has a non-deformable neck 18 that extends from the connecting portion 14 where the neck 18 defines a cavity 20 with a closed inner end 24, an open outer end 26 and a cross-sectional area that is substantially equal along substantially the entire depth 22 between the inner end 24 and the outer end 26 as well as substantially equal to the diameter of the cable 12, (c) solder 28 secured within the cavity 20 and (d) flux 30 secured within the cavity 20 in contact with the solder 28; (2) inserting the multi-strand cable 12 into the cavity 20; (3) applying heat 38 to the neck 18 to melt the flux 30 and the solder 28; (4) further inserting the cable 12 into the cavity 20 to facilitate movement of the solder 28 and flux 30 along the strands 36 and the surface of the cavity 20; and (5) removing the heat 38 to allow solidification of the solder 28.

Inserting the cable 12 into the cavity 20 prior to heating the neck 18 not only prevents the molten solder 28 from spilling out of the cavity 20, it also prevents the formation of a "cold solder" between the cable 12 and the connector 10. Such a connection can occur when the molten solder 28 does not wick-up amongst the strands 36 of the cable 12. In such an instance, the cable 12 can eventually be pulled out of the connector 10 as only the tips of the strands 36 are secured to the solder 28.

In another embodiment of the method, the multi-strand cable 12 has an insulation-free section of sufficient length such that the further inserting step allows the end of the cable 12 to contact the inner end 24 of the cavity 20. Such a connection ensures that the solder 28 will be displaced amongst the strands 36 of the cable 12 thereby resulting in a solid connection.

In yet another embodiment of the method, the further inserting of the cable 12 results in a more secure connection as solder 28 is displaced by the cable 12 and forced along the sidewalls 34 of the cavity 20 and between the various strands 36 of wire.

In still another embodiment of the method, heat 38 is applied to the neck 18 to melt the flux 30 and the solder 28 prior to inserting the cable 12 into the cavity 20.

Figure 4:
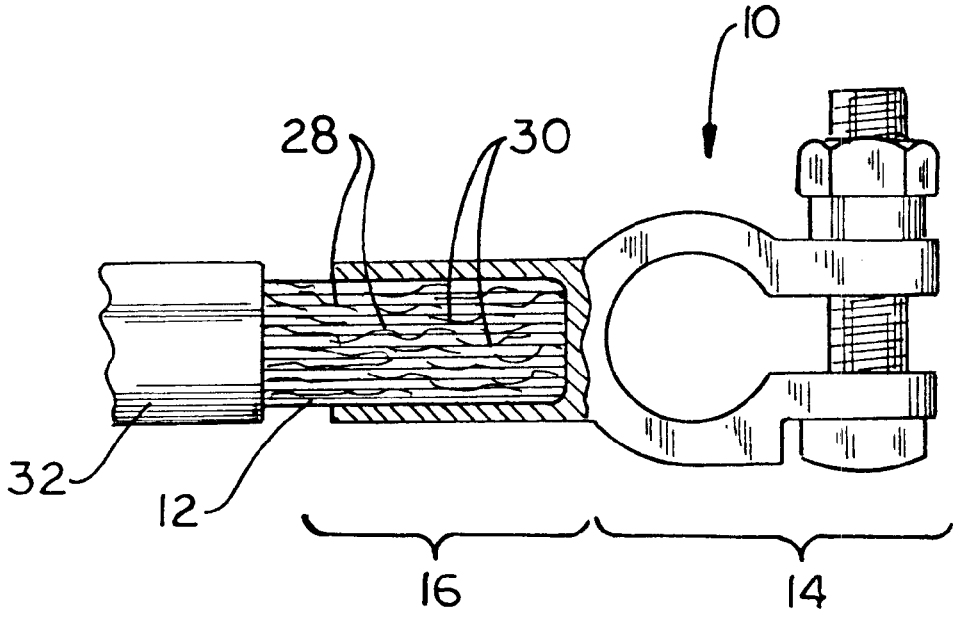
FIG. 4 is a top view of a combination connector and cable showing the cable fully inserted into the neck cavity and a sectional view of the neck with molten solder and flux along the cavity walls and extending between the strands of the cable under the insulation.

The invention, as shown in FIG. 4, also involves a combination connector 10 and attachment cable 12 made by the process comprising the steps of (1) providing a battery connector 10 having (a) a connecting portion 14 for engagement with the battery terminal, (b) a rigid cable-attachment portion 16 with a non-deformable neck 18 extending from the connecting portion 14, the neck 18 defining a cavity 20 with a closed inner end 24, an open outer end 26 and a cross-sectional area that is substantially equal along substantially the entire depth 22 between the inner end 24 and the outer end 26 as well as substantially equal to the diameter of the cable 12, (c) solder 28 secured within the cavity 20 and (d) flux 30 secured within the cavity 20 in contact with the solder 28; (2) inserting the multi-strand electric cable 12 into the cavity 20; (3) applying heat 38 to the neck 18 to melt the flux 30 and the solder 28; (4) further inserting the cable 12 into the cavity 20 to facilitate movement of the solder 28 and flux 30 along the strands 36 and the surface 34 of the cavity 20 and beyond the cavity 20 and between the strands 36; and (5) removing the heat 38 to allow solidification of the solder 28.

Another embodiment of the invention involves a battery connector 10 for electrically connecting a multi-strand cable 12 having a diameter to a battery terminal, the battery connector 10 comprising a connecting portion 14 for engagement with a battery terminal and, a rigid cable-attachment portion 16 including a non-deformable neck 18 extending from the connecting portion 14 and defining a cavity 20 having a depth 22, a closed inner end 24, an open outer end 26 and a cross-sectional area that is substantially equal along substantially the entire depth 22 between the inner end 24 and the outer end 26 as well as substantially equal to the diameter of the cable 12, solder 28 secured within the cavity 20, and flux 30 secured within the cavity 20 in contact with the solder 28, the solder 28 and flux 30 being of amounts suitable for soldering engagement of the cable 12 to the cable-attachment portion 16, thereby facilitating soldering of the multi-strand cable 12 to the battery connector 10.

While the principles of the invention have been shown and described in connection with but a few embodiments, it is to be understood clearly that such embodiments are by way of example and are not limiting.

What is claimed is:

1. A battery connector for electrically connecting a multi-strand automotive-type cable having a diameter to an automotive-type battery terminal, the battery connector comprising:

a connecting portion for engagement with an automotive-type battery terminal; and a rigid cable-attachment portion including:

a non-deformable neck extending from the connecting portion and defining a cavity having a depth, a closed inner end, an open outer end and a cross-sectional area that is substantially equal along substantially the entire depth between the inner end and the outer end as well as substantially equal to the diameter of the cable;

solder secured within the cavity; and flux secured within the cavity in contact with the solder and in contact with the inner end of the cavity, the solder and flux being of amounts suitable for soldering engagement of the cable to the cable-attachment portion, thereby facilitating soldering of the automotive-type cable to the battery connector.

2. The battery connector of claim 1 wherein:

the multi-strand automotive-type cable is surrounded by insulation and includes a length free of insulation; and the depth of the cavity is no greater than the length free of insulation.

3. The battery connector of claim 1 wherein at least about one-half of the depth of the cavity is filled with solder.

4. The battery connector of claim 1 wherein the cavity has a cylindrical lateral wall and the solder conforms to and is joined with the lateral wall.

5. The battery connector of claim 4 wherein the solder is a solder body formed in situ in the cavity.

6. The battery connector of claim 1 wherein the flux is a mass.

7. The battery connector of claim 6 wherein the flux is sealed within the cavity.

8. The battery connector of claim 7 wherein the flux is sealed within the cavity by the solder.

9. A method for permanently attaching a multi-strand automotive-type cable to a battery connector comprising:

providing a battery connector having (1) a connecting portion for engagement with an automotive-type battery terminal, (2) a rigid cable-attachment portion with a non-deformable neck extending from the connecting portion, the neck defining a cavity with a closed inner end, an open outer end and a cross-sectional area that is substantially equal along substantially the entire depth between the inner end and the outer end as well as substantially equal to the diameter of the cable, (3) solder secured within the cavity and (4) flux secured within the cavity in contact with the solder and in contact with the inner end of the cavity, the solder and flux being of amounts suitable for soldering engagement of the cable to the cable-attachment portion;

inserting the multi-strand cable into the cavity;

applying heat to the neck to melt the flux and the solder;

further inserting the cable into the cavity to facilitate movement of the solder and flux along the strands and the surface of the cavity; and removing the heat to allow solidification of the solder.

10. The method of claim 9 wherein the multi-strand cable has an insulation-free section of sufficient length such that the further inserting step allows the end of the cable to contact the end of the cavity.

11. The method of claim 9 wherein the further inserting of the cable displaces the melted flux and solder thereby causing the flux and solder to wick-up beyond the cavity amongst the cable strands.

12. A method for permanently attaching a multi-strand cable having a diameter to a connector comprising:

providing a connector having (1) a connecting portion for engagement with a terminal, (2) a rigid cable-attachment portion with a non-deformable neck extending from the connecting portion, the neck defining a cavity with a closed inner end, an open outer end and a cross-sectional area that is substantially equal along substantially the entire depth between the inner end and the outer end as well as substantially equal to the diameter of the cable, (3) solder secured within the cavity and (4) flux secured within the cavity in contact with the solder and in contact with the inner end of the cavity, the solder and flux being of amounts suitable for soldering engagement of the cable to the cable-attachment portion;

applying heat to the neck to melt the flux and the solder;

inserting the cable into the cavity to facilitate movement of the solder and flux along the strands and the surface of the cavity; and removing the heat to allow solidification of the solder.

13. A combination connector and attached multi-strand cable made by the process comprising the steps of:

providing a connector having (1) a connecting portion for engagement with a terminal, (2) a rigid cable-attachment portion with a non-deformable neck extending from the connecting portion, the neck defining a cavity with a closed inner end, an open outer end and a cross-sectional area that is substantially equal along substantially the entire depth between the inner end and the outer end as well as substantially equal to the diameter of the cable, (3) solder secured within the cavity and (4) flux secured within the cavity in contact with the solder and in contact with the inner end of the cavity, the solder and flux being of amounts suitable for soldering engagement of the cable to the cable-attachment portion;

inserting the multi-strand cable into the cavity;

applying heat to the neck to melt the flux and the solder;

further inserting the cable into the cavity to facilitate movement of the solder and flux along the strands and the surface of the cavity and beyond the cavity between the strands; and removing the heat to allow solidification of the solder.

14. The combination of claim 13 wherein at least about one-half of the depth of the cavity is filled with solder whereby the strength of the cable is enhanced beyond the cavity.

15. A battery connector for electrically connecting a multi-strand cable having a diameter to a battery terminal, the battery connector comprising:

a connecting portion for engagement with a battery terminal; and a rigid cable-attachment portion including:

a non-deformable neck extending from the connecting portion and defining a cavity having a depth, a closed inner end, an open outer end and a cross-sectional area that is substantially equal along substantially the entire depth between the inner end and the outer end as well as substantially equal to the diameter of the cable;

solder secured within the cavity; and flux secured within the cavity in contact with the solder, and in contact with the inner end of the cavity, the solder and flux being of amounts suitable for soldering engagement of the cable to the cable-attachment portion, thereby facilitating soldering of the cable to the battery connector.

* * * * *